US011407095B2

(12) United States Patent
Hoshino et al.

(10) Patent No.: US 11,407,095 B2
(45) Date of Patent: Aug. 9, 2022

(54) STRIKING TOOL

(71) Applicant: MAX CO., LTD., Tokyo (JP)

(72) Inventors: Takamichi Hoshino, Tokyo (JP); Yasushi Yokochi, Tokyo (JP); Yoshihiko Kondo, Tokyo (JP); Yosei Nodaguchi, Tokyo (JP); Takashi Suzuki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 117 days.

(21) Appl. No.: 16/742,310

(22) Filed: Jan. 14, 2020

(65) Prior Publication Data

US 2020/0223046 A1 Jul. 16, 2020

(30) Foreign Application Priority Data

Jan. 15, 2019 (JP) ..... JP2019-004220

(51) Int. Cl.
*B25C 7/00* (2006.01)
*B25C 5/15* (2006.01)

(52) U.S. Cl.
CPC . *B25C 7/00* (2013.01); *B25C 5/15* (2013.01)

(58) Field of Classification Search
CPC .... B25C 7/00; B25C 5/15; B25C 1/06; B25C 1/047
See application file for complete search history.

(56) References Cited

U.S. PATENT DOCUMENTS 3,516,590 A * 6/1970 Timmerbell ..... B25C 1/005 227/123
6,050,471 A * 4/2000 Yagi ..... B27F 7/36 227/138
9,321,162 B2 * 4/2016 Adachi ..... B25C 1/06
2005/0194419 A1 * 9/2005 Smolinski ..... B25C 1/047 227/130
2009/0179062 A1 * 7/2009 Shima ..... B25C 1/06 227/2
2015/0202755 A1 * 7/2015 Tanji ..... B25C 1/047 227/130

(Continued)

FOREIGN PATENT DOCUMENTS

EP 0209916 A2 3/1984
JP 2007090473 A 4/2007
WO 2018020955 A1 2/2018

OTHER PUBLICATIONS

The Extended European Search Report mailed in corresponding EP Patent Application No. 20151730.7 dated Jun. 29, 2020 (8 pages).

*Primary Examiner* — Thomas M Wittenschlaeger
*Assistant Examiner* — Katie L Gerth
(74) *Attorney, Agent, or Firm* — Weihrouch IP

(57) ABSTRACT

A striking tool includes: a driver which is provided to be slidable toward an ejecting port provided in a tip end of the striking tool so as to strike out a fastener from the ejecting port; a plunger to which the driver is coupled; a plunger urging member which is configured to urge the plunger toward the ejecting port: and a drive mechanism which is configured to move the plunger to accumulate urging force in the plunger urging member. A standby position of the plunger before striking out the fastener can be switched between a usual standby position and a standby position for maintenance closer to the ejecting port than the usual standby position.

14 Claims, 11 Drawing Sheets

(56) References Cited

U.S. PATENT DOCUMENTS

| | | | | |
|---|---|---|---|---|
| 2016/0059399 | A1* | 3/2016 | Wong | B25C 1/045<br>29/888.01 |
| 2017/0129085 | A1* | 5/2017 | Miyashita | F16H 19/04 |
| 2019/0168366 | A1* | 6/2019 | Yasutomi | B25C 1/047 |

* cited by examiner 23a
23
22
32a
22a
32b
21
11

STRIKING TOOL

CROSS-REFERENCE TO RELATED APPLICATIONS

This application is based upon and claims the benefit of priority from prior Japanese patent application No. 2019-004220, filed on Jan. 15, 2019, the entire contents of which are incorporated herein by reference.

TECHNICAL FIELD

The present disclosure relates to a striking tool configured to strike out a fastener from an ejecting port provided in a tip end of the tool, and particularly, to a striking tool for which it is possible to easily perform maintenance.

BACKGROUND ART

Such a type of the striking tool has a driver slidably arranged therein so as to strike the fastener. When replacing the driver, it is necessary to disassemble a body to expose the driver, so that it is troublesome to perform a failure repair. Also, since it is difficult for a user to disassemble the body and to again assemble the same, it is substantially impossible for the user to perform the replacement operation of the driver.

As related technology, for example, PTL 1 discloses a configuration in which a housing is configured by left side, right side and front side components. The front side component is detached to expose the driver, so that it is possible to replace the driver.

PTL 1: JP-A-2007-90473

However, in the configuration disclosed in PTL 1, it is necessary to largely open the front surface of the body so as to replace the driver. For this reason, the housing is configured by the left side, right side and front side components, which increases the cost due to complication of a mold structure and an increase in the number of components. Also, since an opening and closing structure is complicated, the tool is enlarged and the maintenance operability is not good.

Also, in the configuration disclosed in PTL 1, when replacing the driver, the driver stands by in a state in which a compression coil spring is compressed, so that the driver may operate during an operation. Therefore, a user cannot perform the replacement operation of the driver for a safety reason.

It is therefore an object of the present disclosure to provide a striking tool enabling a driver to be replaced safely and easily and having a simple structure.

SUMMARY OF INVENTION

According to an aspect of the present disclosure, there is provided a striking tool comprising: a driver which is provided to be slidable toward an ejecting port provided in a tip end of the striking tool so as to strike out a fastener from the ejecting port; a plunger to which the driver is coupled; a plunger urging member which is configured to urge the plunger toward the ejecting port; and a drive mechanism which is configured to move the plunger to accumulate urging force in the plunger urging member, wherein a standby position of the plunger before striking out the fastener can be switched between a usual standby position and a standby position for maintenance closer to the ejecting port than the usual standby position.

BRIEF DESCRIPTION OF DRAWINGS

FIGS. 11A to 11E illustrate aspects in which a plunger is being pushed up by a drive mechanism, in which FIG. 11A is a front view of the drive mechanism, FIG. 11B schematically depicts the drive mechanism in a state in which the plunger is located at a bottom dead point. FIG. 11C schematically depicts the drive mechanism in a state in which the plunger is located between the bottom dead point and a top dead point (in a standby position), FIG. 11D schematically depicts the drive mechanism in a state in which the plunger is located at the top dead point, and FIG. 11E schematically depicts the drive mechanism immediately after engagement between the plunger and the drive mechanism is released.

DESCRIPTION OF EMBODIMENTS

An exemplary embodiment of the present disclosure will be described with reference to the drawings.

Figure 1:
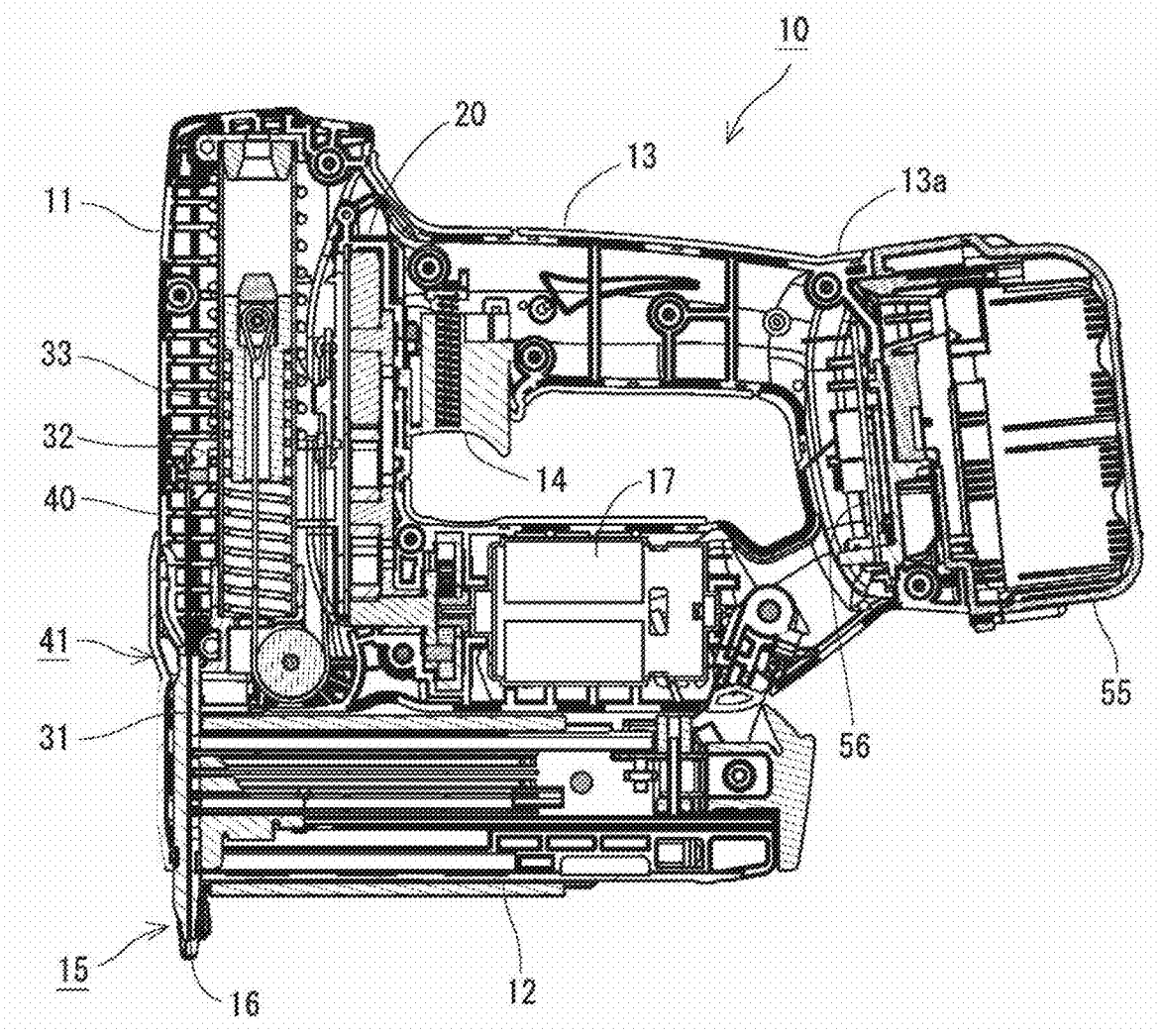
FIG. 1 is a side sectional view of a striking tool located in a usual standby position.

A striking tool 10 of the exemplary embodiment is a spring drive-type striking tool 10 that is to drive by a spring force. As shown in FIG. 1, the striking tool 10 includes a motor 17 in a housing 40, and is configured to drive by the motor 17, thereby striking out a fastener from an ejecting port 16 provided in a tip end of the tool.

As shown in FIG. 1, the striking tool 10 includes an output part 11 having a drive mechanism 20 accommodated therein, a magazine 12 connected to a tip end side of the output part 11 perpendicularly to the output part 11, and a grip 13 connected to a rear end side of the output part 11 perpendicularly to the output part 11.

The tip end of the output part 11 is provided with a nose part 15, which is to be pressed to a member to be struck, and a head fastener loaded in the magazine 12 is supplied to the nose part 15 by a supply device (not shown). The fastener supplied to the nose part 15 is struck out from the ejecting port 16 provided in the tip end of the nose part 15 by a driver 31.

Also, as shown in FIG. 1, in the output part 11, a driver 31 provided to be slidable toward the ejecting port 16 so as to strike out a fastener, a plunger 32 to which the driver 31 is coupled, a plunger urging member 33 configured to urge the plunger 32 toward the ejecting port 16, a drive mechanism 20 for actuating the plunger 32, and the like are arranged.

Figure 2:
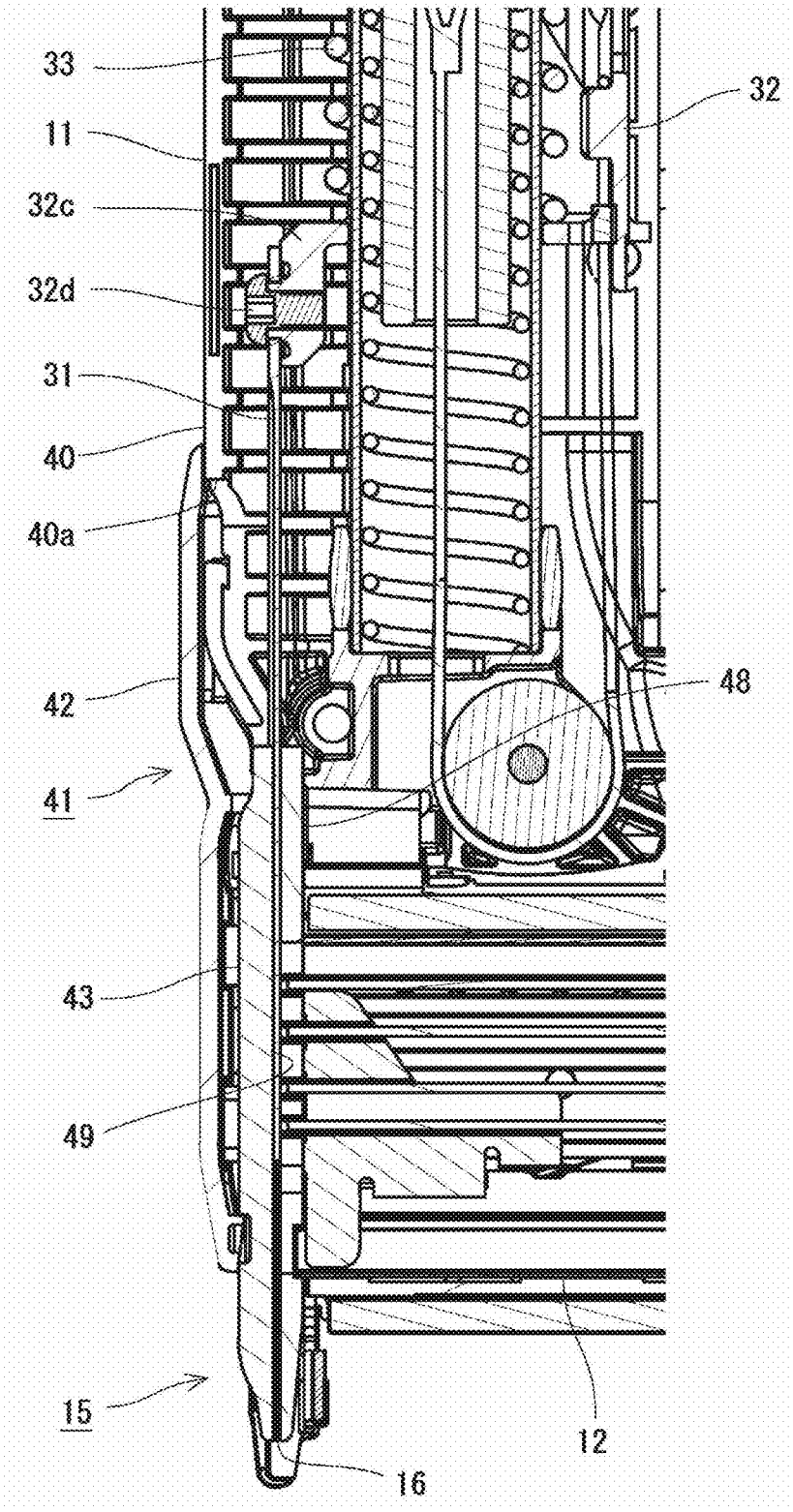
FIG. 2 is partially enlarged side sectional view of the striking tool located in the usual standby position.

The driver 31 of the exemplary embodiment is a plate for striking a fastener. As shown in FIG. 2, the driver 31 is fixed to the plunger 32 in the vicinity of an upper end thereof. Specifically, the driver 31 is coupled to a driver fixing part 32*c* provided to the plunger 32 by a driver fixing screw 32*d* penetrating the vicinity of the upper end thereof.

The plunger 32 is arranged to be slidable in an ejecting direction in the housing 40. The plunger 32 is urged toward the ejecting port 16 all the time by the plunger urging member 33, which is a compression spring.

The plunger 32 is arranged in the vicinity of the drive mechanism 20, which will be described later, and has a first engagement portion 32*a* and a second engagement portion 32*b* protruding from a surface facing toward the drive mechanism 20. The first engagement portion 32*a* and the second engagement portion 32*b* are projections for engaging with the drive mechanism 20, and are provided with different intervals from the ejecting port 16. Specifically, the first engagement portion 32*a* is provided in a position closer to the ejecting port 16 than the second engagement portion 32*b*.

The drive mechanism 20 is a mechanism configured to push up the plunger 32 against the urging force of the plunger urging member 33. The drive mechanism 20 is configured to move the plunger 32 by using the motor 17 as a power source, to accumulate the urging force in the plunger urging member 33, and to release the urging force in a drive to instantaneously slide the plunger 32, thereby executing a striking operation.

The drive mechanism 20 includes a plurality of gears as shown in FIGS. 11A to 11E. The plurality of gears is configured to rotate by drive force of the motor 17. The drive mechanism 20 is configured to rotate the gears in a state in which the plunger 32 is engaged to the gears, thereby pushing up the plunger 32. The drive mechanism is configured to move the plunger 32 with the urging force of the plunger urging member 33 and to slide the driver 31 coupled to the plunger 32 toward the ejecting port 16, by releasing the engagement between the gears and the plunger 32, thereby striking out a fastener.

Figures 11A, 11B, 11C, 11D, 11E:
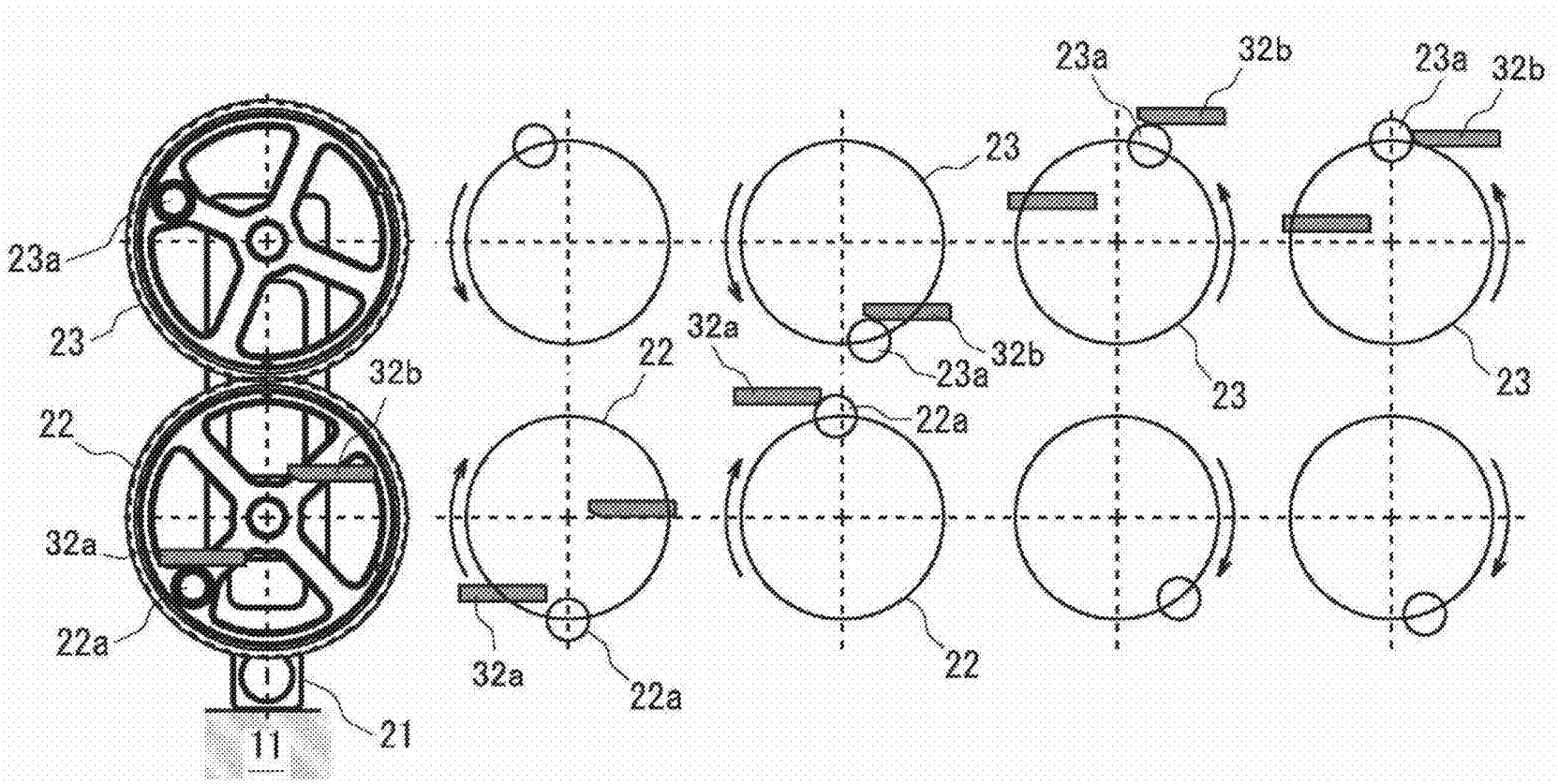

As shown in FIG. 11A, the drive mechanism 20 includes a torque gear plate 21 fixed to the housing 40 of the output part 11, and a first torque gear 22 and a second torque gear 23 pivotably supported to the torque gear plate 21. The first torque gear 22 and the second torque gear 23 are arranged side by side in a sliding direction of the plunger 32, and the first torque gear 22 is arranged closer to the ejecting port 16 than the second torque gear 23. Thereby, the plunger 32 is engaged in order from the first torque gear 22 to the second torque gear 23, and is thus gradually raised.

FIG. 11B depicts a state in which the plunger 32 is located in a position of a bottom dead center (a state in which the striking of the fastener by the driver 31 is completed). When the first torque gear 22 and the second torque gear 23 are rotated from this state, a first torque roller 22*a* provided in an eccentric position of the first torque gear 22 is engaged to the first engagement portion 32*a* of the plunger 32.

Then, as shown in FIG. 11C, the plunger 32 is raised upward by the first torque gear 22, as it is. When the first torque gear 22 is rotated up to a position in which the first torque roller 22*a* is located at the top, the engagement between the first torque roller 22*a* and the first engagement portion 32*a* is released. At this time, before the engagement between the first torque roller 22*a* and the first engagement portion 32*a* is released, a second torque roller 23*a* provided in an eccentric position of the second torque gear 23 is engaged to the second engagement portion 32*b* of the plunger 32.

Then, as shown in FIG. 11D, the plunger 32 is raised upward by the second torque gear 23, as it is, and the plunger 32 is moved to a position of a top dead center.

Thereafter, as shown in FIG. 11E, when the gears are further rotated and the second torque gear 23 is thus rotated up to a position in which the second torque roller 23*a* is located at the top, the engagement between the second torque roller 23*a* and the second engagement portion 32*b* is released. Thereby, the engagement between the plunger 32 and the drive mechanism 20 is released and the urging force of the plunger urging member 33 is released, so that the plunger 32 is instantaneously moved to the position of the bottom dead center shown in FIG. 11B. Thereby, the driver 31 coupled to the plunger 32 is vigorously slid toward the ejecting port 16, thereby striking out a fastener standing by in an ejecting path 49 from the ejecting port 16.

In the exemplary embodiment, the plunger 32 before the striking is configured to stand by in a usual standby position (a position on the way from the bottom dead center to the top dead center) shown in FIG. 11C. When an operation part 14, which will be described later, is operated, the drive mechanism 20 is actuated, so that the plunger again stands by in the usual standby position shown in FIG. 11C via the states in order of FIG. 11D→FIG. 11E→FIG. 11B.

Also, the striking tool 10 of the exemplary embodiment includes a brake switch (not shown) for controlling a timing at which the rotation of the motor 17 is to be stopped. The brake switch is arranged in a position in which it is pressed by the plunger 32 when the plunger 32 is located in the position of the top dead center (immediately before the engagement between the plunger 32 and the drive mechanism 20 is released). When the brake switch is pressed, a brake signal is output to a control device 56, which will be described later. The control device 56 stops the drive of the motor 17 when the brake signal is input.

The magazine 12 is to load therein fasteners that are to be struck out by the driver 31. In the tool of the exemplary embodiment, a fastener having a plurality of fasteners coupled side by side is loaded in the magazine 12.

The grip 13 is a part that is to be gripped by an operator who uses the striking tool 10. The grip 13 has a rod shape so that the operator can easily grip the same. Also, an operation part 14 that can be pulled by an index finger of the operator is provided in a position in which the index finger is put thereon when the operator grips the grip 13. When the operation part 14 is operated, a trigger switch arranged in the grip 13 becomes on, so that an operation signal is output to the control device 56, which will be described later. The control device 56 starts to drive the motor 17 when the operation signal is input.

Also, a rear end of the grip 13 (an end on an opposite side to the output part 11) is formed with a battery mounting part 13*a* for mounting a battery 55 thereto. The striking tool 10 of the exemplary embodiment is configured to drive by power that is fed from the battery 55 mounted to the battery mounting part 13*a*. The battery 55 has a secondary battery embedded therein, and can be removed from the striking tool 10 for charging.

Also, in the battery mounting part 13*a*, a control device 56 for controlling operations of the striking tool 10 is arranged. The control device 56 is mainly configured by a CPU, and includes a ROM, a RAM, an I/O and the like. The CPU reads a program stored in the ROM, so that a variety of input devices and output devices are controlled.

For example, when the operation part 14 is operated, the control device 56 performs control of driving the motor 17, and when a state of the brake switch is changed, the control device 56 performs control of stopping the motor 17.

Specifically, when the operation part 14 is operated in a standby state (a usual standby state shown in FIG. 1 or a standby state for maintenance shown in FIG. 3), the trigger switch becomes on, so that an operation signal is output to the control device 56. The control device 56 starts to drive the motor 17 when the operation signal is received from the trigger switch. When the motor 17 is rotated, the drive mechanism 20 is actuated to gradually raise upward the plunger 32.

When the plunger 32 is moved to the position of the top dead center, the plunger 32 pushes the brake switch 41. Immediately after that, the engagement between the drive mechanism 20 and the plunger 32 is released and the plunger 32 and the driver 31 are instantaneously moved toward the ejecting port 16 by the urging force accumulated in the plunger urging member 33. Thereby, the plunger 32 is moved to the position of the bottom dead center, so that a fastener is struck out.

Thereafter, when the motor 17 is rotated until it returns to the usual standby state, the control device 56 stops the motor 17. At this time, the timing at which the motor 17 is to be stopped is set by measuring a time period after the brake switch becomes on until it becomes off again. For example, the control device 56 measures 0.5 second after the brake switch becomes off, and stops the motor 17 after 0.5 second. In this way, the motor 17 is stopped after the predetermined time period elapses since the brake switch becomes off (since the fastener is struck), so that the plunger 32 can be moved and stopped in the usual standby position in which the predetermined urging force is accumulated in the plunger urging member 33. In this way, when the plunger 32 is stopped in the vicinity of the top dead center, it is possible to shorten a time period after the operation part 14 is operated until a fastener is struck out during a next striking operation. Thereby, it is possible to continuously perform the operation smoothly without causing the operator to feel the waiting time. Here, the usual standby position in the exemplary embodiment is a position which is between the top dead center and the bottom dead center and in which the predetermined urging force is accumulated in the plunger urging member 33.

In the meantime, the striking tool 10 of the exemplary embodiment is configured to switch the standby position of the plunger 32 before striking out the fastener between the usual standby state and the standby position for maintenance closer to the ejecting port 16 than the usual standby position. That is, after striking out the fastener, the plunger 32 moves and stands by in the usual standby position. However, a preset operation is performed, so that the plunger 32 moves and stands by in the standby position for maintenance.

The preset operation for switching to the standby position for maintenance may be an operation of using the operation part 14 for striking out the fastener. For example, in a state in which a safety device is operating so that a fastener is not to be struck out even when the operation part 14 is operated, when the operation part 14 is continuously performed within a predetermined time period by a predetermined number of times, the plunger may be switched to the standby position for maintenance.

In addition, a maintenance operation part may be provided separately from the operation part 14. When the maintenance operation part is operated, the standby position of the plunger 32 may be switched from the usual standby position to the standby position for maintenance. When the dedicated maintenance operation part for switching the standby state is provided, it is possible to prevent an erroneous operation or actuation.

Also, the standby position may be switched to the standby position for maintenance by a combination of the operation part 14 and the dedicated maintenance operation part for switching the standby state. For example, when the operation part 14 is operated while pressing a button of the maintenance operation part (represented schematically at B in FIG. 3), the standby position may be switched to the standby position for maintenance.

Also, a notification unit (represented schematically at A in FIG. 3) configured to notify that the plunger 32 is in the standby position for maintenance may be provided. An aspect of the notification unit is not particularly limited. For example, auditory notification by a buzzer sound or the like, visual notification by lighting of an LED or the like, and haptic notification by vibrations of a vibration motor may be made. The notification may be executed just once when switched to the standby position for maintenance or may be continuously or intermittently executed until the standby position for maintenance is released.

Figure 3:
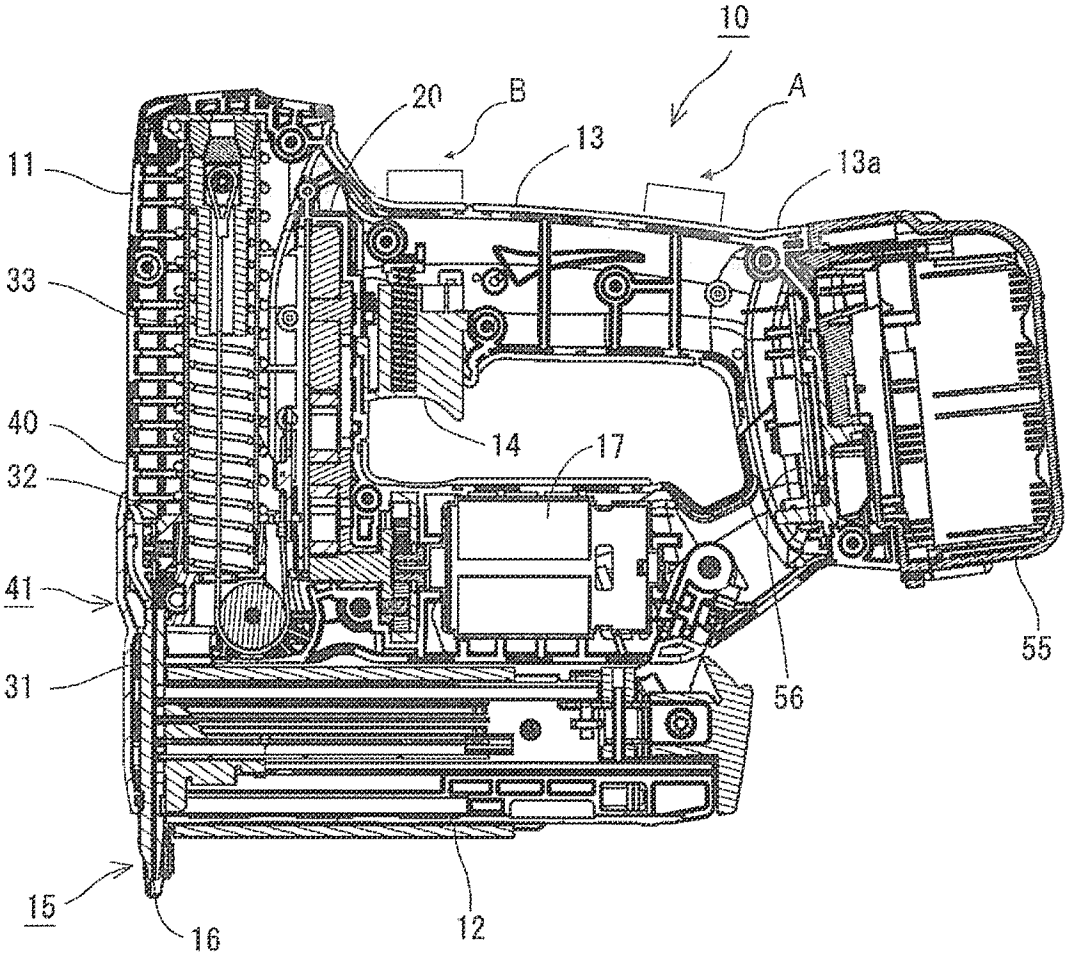
FIG. 3 is a side sectional view of the striking tool located in a standby position for maintenance.
Figure 4:
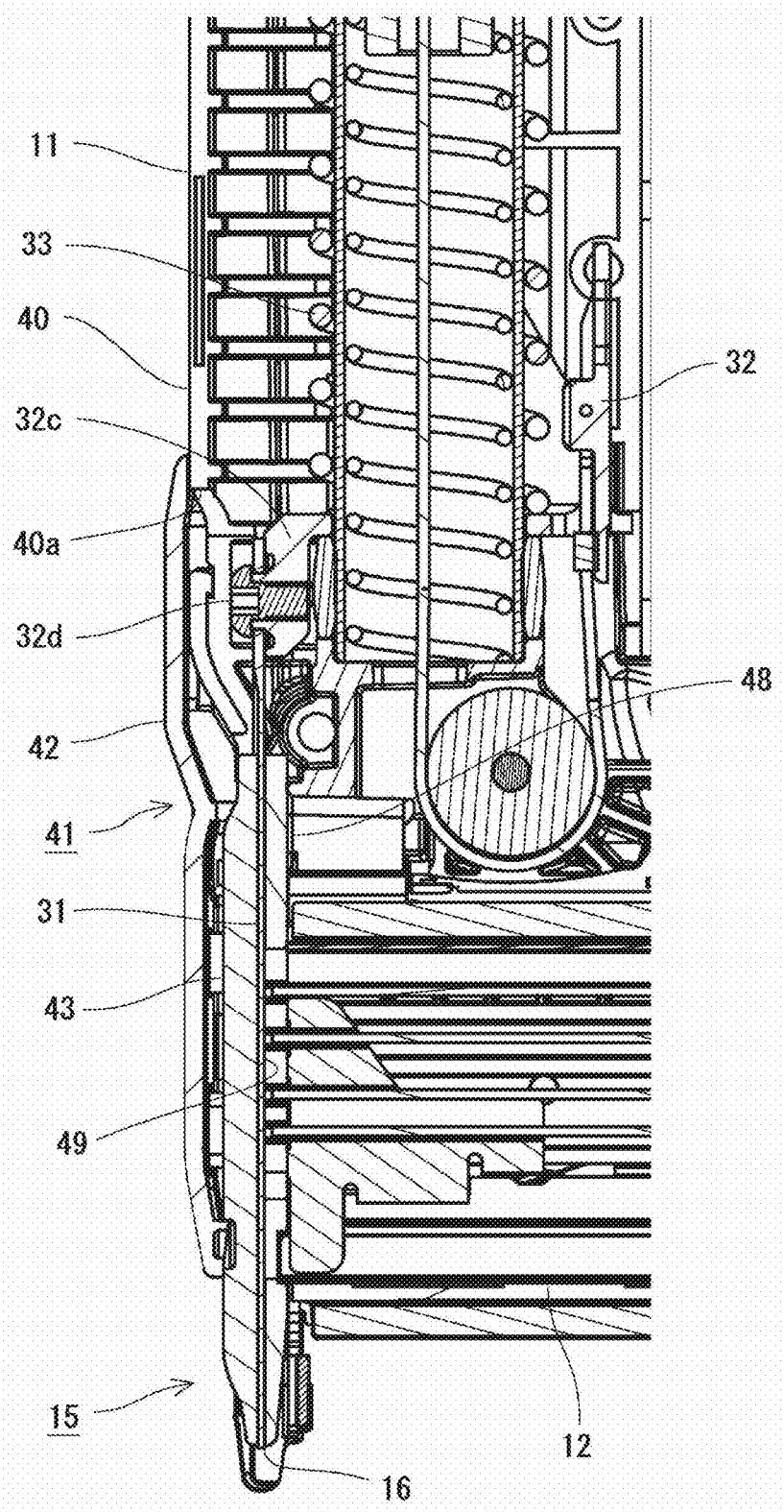
FIG. 4 is partially enlarged side sectional view of the striking tool located in the standby position for maintenance.

When the plunger 32 is moved to the standby position for maintenance, the plunger 32 and the driver 31 are moved to the vicinity of the ejecting port 16, as shown in FIGS. 3 and 4. Since the standby position for maintenance in the exemplary embodiment is the position of the bottom dead point of the plunger 32, the urging force of the plunger urging member 33 is minimized. In this way, the plunger 32 is made to stand by in the standby position for maintenance, so that it is possible to easily perform the maintenance such as replacement of the driver 31.

Figure 7:
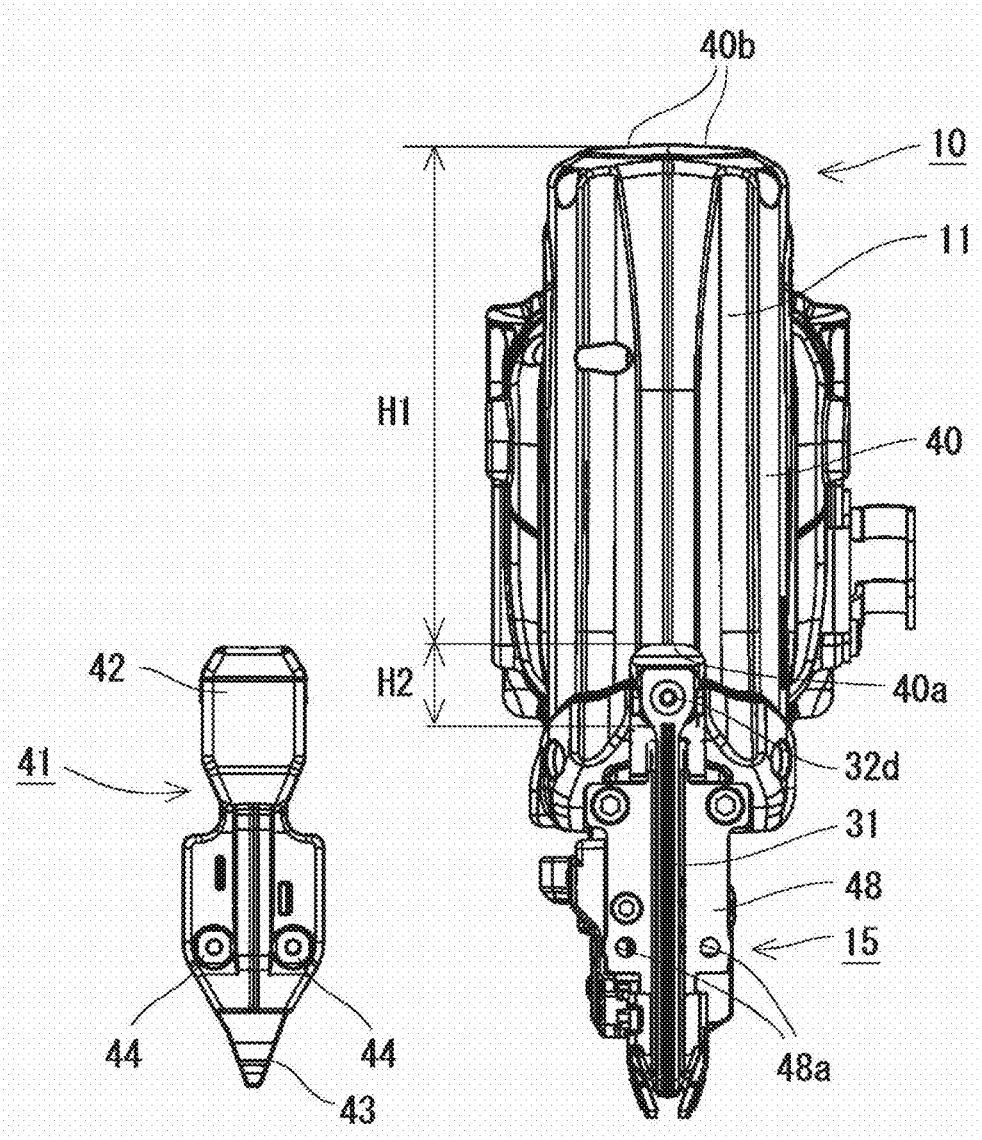
FIG. 7 is a front view of the striking tool from which a cover has been detached.
Figure 8:
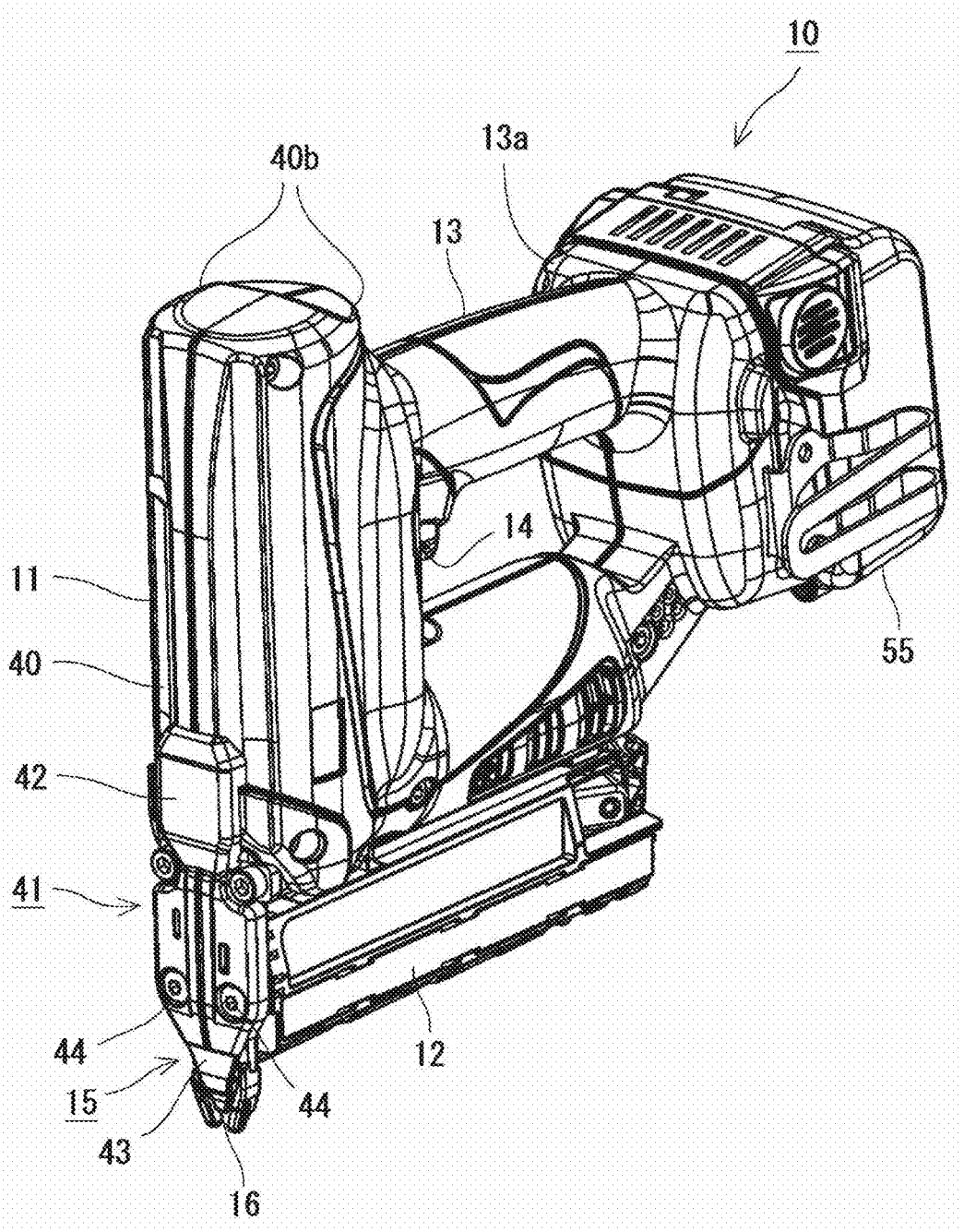
FIG. 8 is a perspective view of the striking tool.

As shown in FIGS. 7 and 8, for example, the housing 40 of the striking tool 10 of the exemplary embodiment is configured by a combination of left and right split pieces **40*b*. The left and right split pieces 40*b* are combined, so that an outer shell of the cylindrical output part 11 having the drive mechanism 20, the plunger urging member 33 and the like embedded therein is formed, as shown in FIG. 1**, for example.

Figure 9:
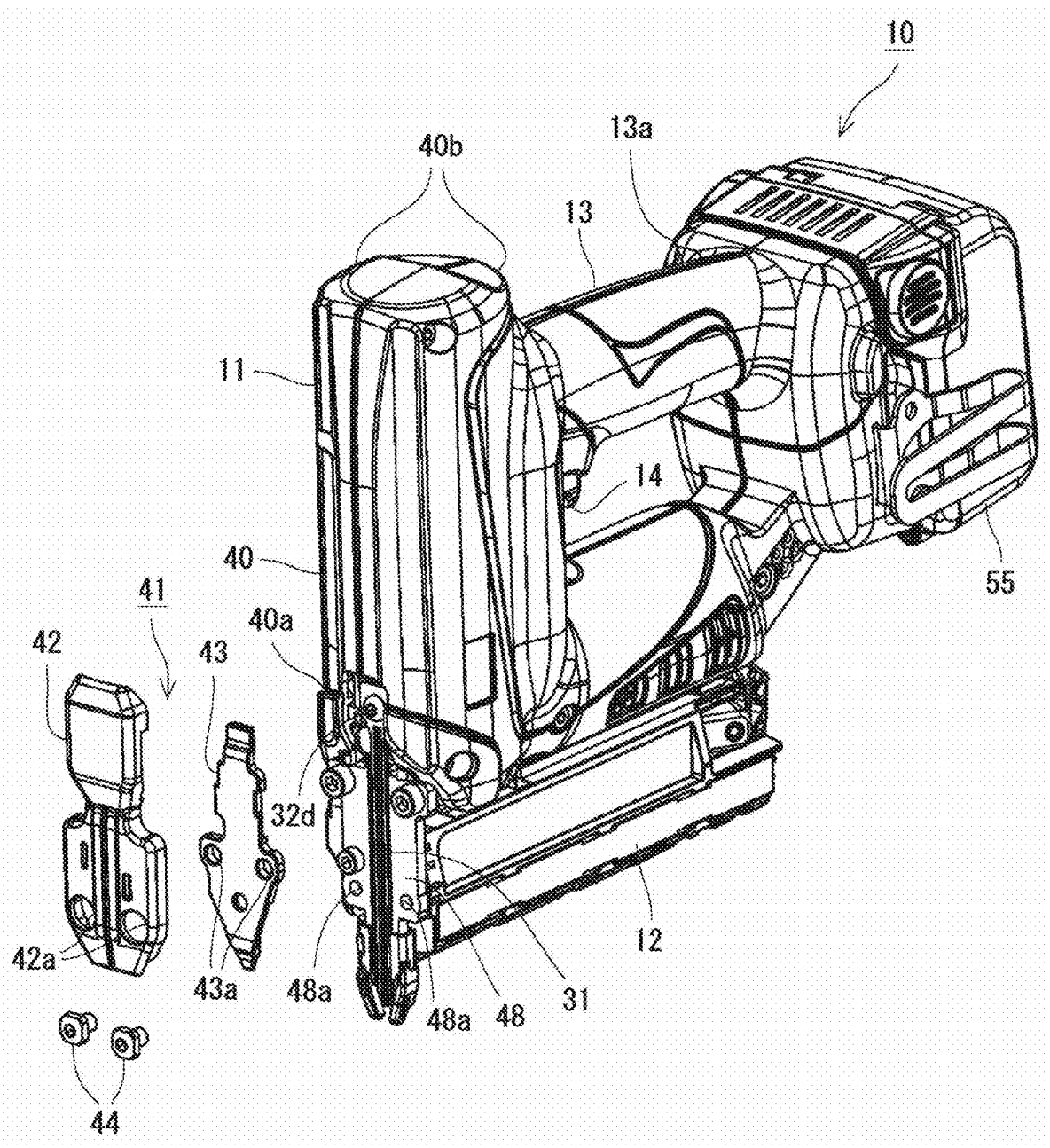
FIG. 9 is a perspective view of the striking tool from the cover has been detached in the standby position for maintenance.

Also, as shown in FIG. 9, a front surface of the housing 40 is formed with a notched shape **40*a* in a position facing the driver 31. The notched shape 40*a* is such a shape obtained by notching an end edge on the ejecting port 16-side of the housing 40 into a substantial U-shape. The notched shape 40*a* is formed so that a notched depth is as shallow as possible. For example, as shown in FIG. 7, when seeing the front surface of the housing 40 in an ejecting direction of the fastener, a notched depth H2 of the notched shape 40*a* is formed smaller than a length H1 of a bonded portion of the left and right split pieces 40*b*. Therefore, even when the notched shape 40*a* is provided, it little influences strength of the housing 40**.

A cover 41 as shown in FIG. 7 is detachably provided to the notched shape **40*a*. When the cover 41 is attached, the notched shape 40*a* is completely covered. In the meantime, the cover 41 is not directly coupled to the housing 40. That is, the cover 41 does not configure the housing 40**.

As shown in FIG. 9, for example, the cover 41 is configured by overlapping a first cover material 42 and a second cover material 43 each other. In the exemplary embodiment, the plurality of components is combined to configure the cover 41. However, the present disclosure is not limited thereto. For example, the cover 41 may be configured by one component.

The first cover material 42 is a member that is formed greater than the second cover material 43 and is arranged on an outer side of the second cover material 43. In the exemplary embodiment, the first cover material 42 is formed of the same material (resin) as the housing 40. The notched shape 40*a* is covered by the first cover material 42.

The second cover material 43 is a member that is interposed and attached between the first cover material 42 and a backside plate 48. In the exemplary embodiment, the second cover material 43 is formed of the same material (metal) as the backside plate 48. In the meantime, the backside plate 48 is a plate-shaped member fixed to a front end of the magazine 12.

As shown in FIG. 2, for example, an ejecting path 49 in communication with the ejecting port 16 is formed between the second cover material 43 and the backside plate 48. The ejecting path 49 is a path along which a fastener is to be struck out, and is configured to slidably guide the driver 31 in the vertical direction. In the meantime, in the usual standby state, as shown in FIG. 2, the driver 31 stands by in the ejecting path 49, and the fastener is not allowed to enter the ejecting path 49. When the driver 31 is moved upward upon the striking, a head fastener loaded in the magazine 12 is pushed to the ejecting path 49. The head fastener sent to the ejecting path 49 is struck out from the ejecting port 16 when the driver 31 is moved downward.

Like this, the second cover material 43 is integrated with the backside plate 48 to form the ejecting path 49. In other words, the fastener and the driver 31 to move in the ejecting path 49 are slid with being guided to the second cover material 43 and the backside plate 48. In this way, the second cover material 43 exhibits a driver guide function of guiding sliding of the driver 31.

As shown in FIG. 8, the first cover material 42 and the second cover material 43 are fixed to a tool main body by left and right attachment screws 44. When attaching the cover 41 to the tool main body, the attachment screws 44 are inserted to continuously pass through insertion holes 42*a* of the first cover material 42 and through-holes 43*a* of the second cover material 43, as shown in FIG. 9. Then, the attachment screws 44 are screwed into attachment holes 48*a* of the backside plate 48. Thereby, the first cover material 42 is pushed in by head portions of the attachment screws 44, and the second cover material 43 is interposed and fixed between the first cover material 42 and the backside plate 48.

Figure 5:
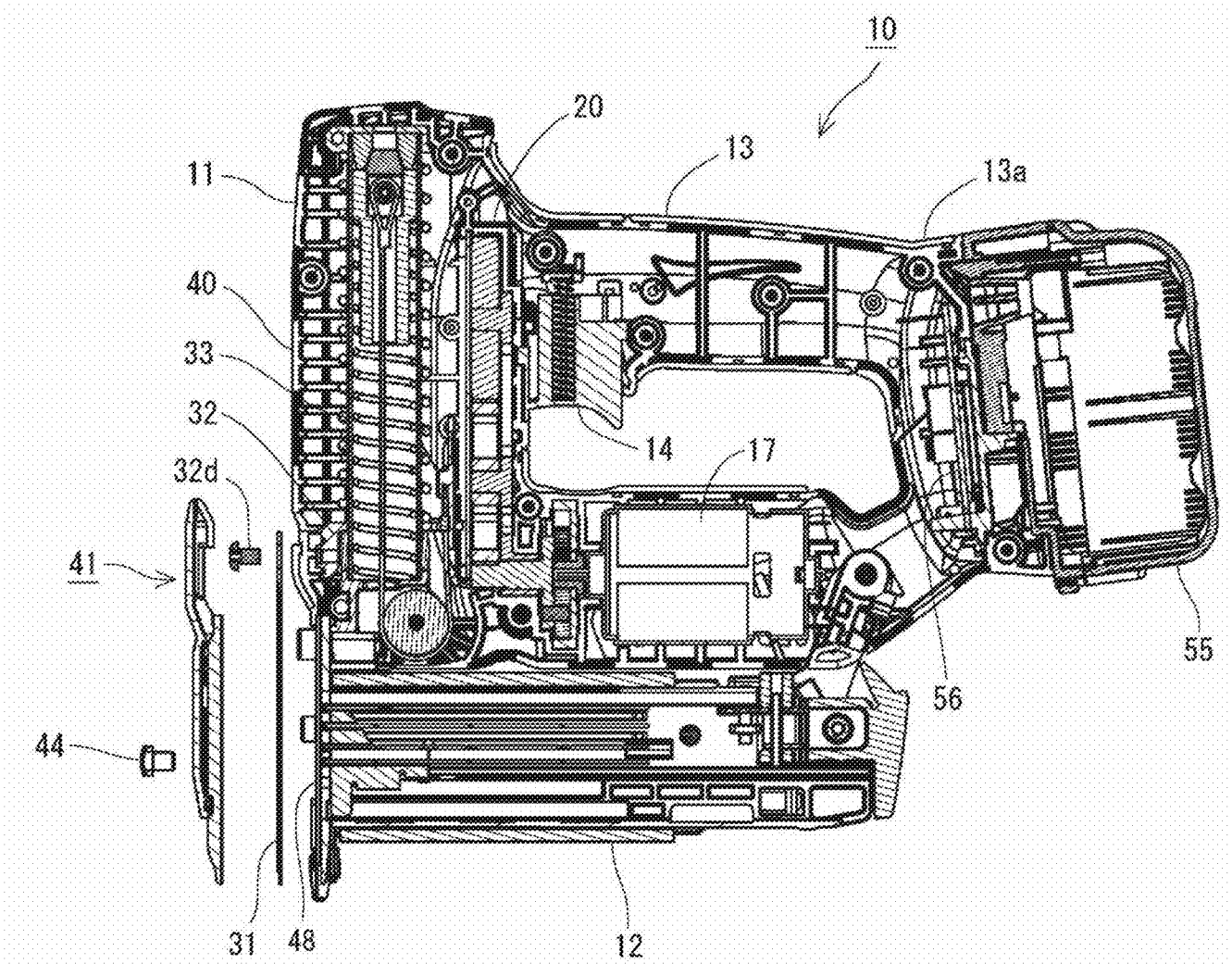
FIG. 5 is a side sectional view of the striking tool from which a driver has been detached.
Figure 6:
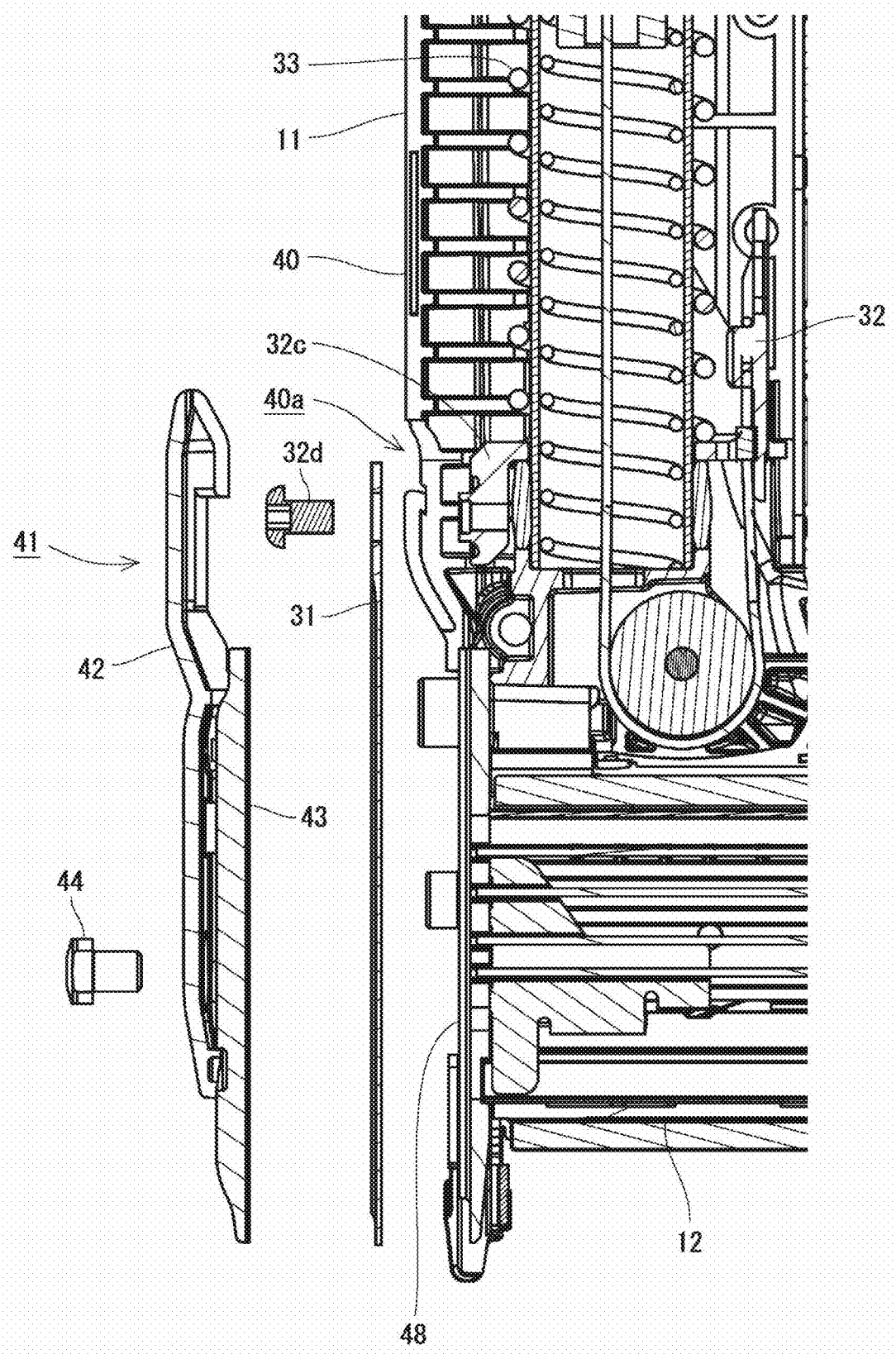
FIG. 6 is partially enlarged side sectional view of the striking tool from which the driver has been detached.

Conversely, the cover 41 (the first cover material 42 and the second cover material 43) can be detached from the tool main body by detaching the attachment screws 44. As shown in FIG. 9, when the cover 41 is detached in a state in which the plunger 32 is located in the standby position for maintenance, the notched shape 40*a* exposes a coupling place (a driver fixing screw 32*d*) of the driver 31 and the plunger 32. For this reason, as shown in FIGS. 5 and 6, the driver 31 can be easily replaced by untightening the driver fixing screw 32*d*.

Figure 10:
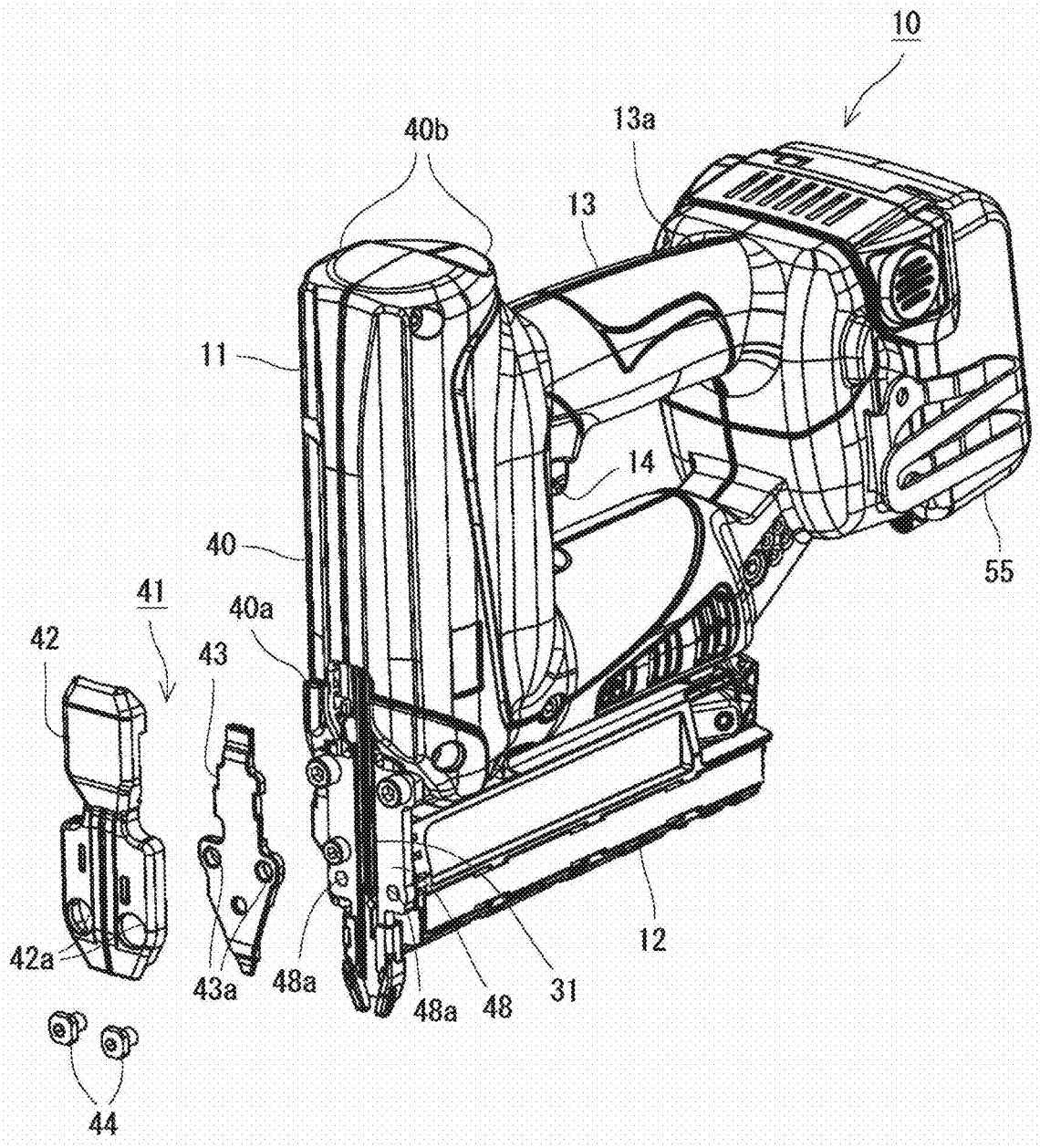
FIG. 10 is a perspective view of the striking tool from the cover has been detached in the usual standby position.

Herein, as described above, the notched shape 40*a* is formed as small as possible. For this reason, as shown in FIGS. 2 and 10, even when the cover 41 is detached in a state in which the plunger 32 is located in the usual standby position, the coupling place (driver fixing screw 32*d*) of the driver 31 and the plunger 32 is not exposed. Like this, the notched shape 40*a* is formed small, so that it is possible to provide the notched shape 40*a* without changing a basic structure of the housing 40 obtained by combining the left and right split pieces 40*b*.

In the meantime, when it is intended to switch the standby position of the plunger 32 from the standby position for maintenance to the usual standby position, a striking operation may be executed. That is, even when the plunger 32 is located in the standby position for maintenance, such as after the driver 31 is replaced, for example, the striking tool 10 can be used in the same manner as usual. Therefore, it is possible to return the standby position to the usual standby position by executing the striking operation. Specifically, when the operation part 14 is operated to perform the striking operation in the state in which the plunger 32 is located in the standby position for maintenance, the plunger 32 is moved and stopped in the usual standby position after the striking operation is performed, like a case in which the operation is performed from the usual standby position.

As described above, the striking tool 10 of the exemplary embodiment can switch the standby position of the plunger 32 before striking out a fastener between the usual standby position and the standby position for maintenance closer to the ejecting port 16 than the usual standby position. According to this configuration, when replacing the driver 31, the standby position of the plunger 32 is set to the standby position for maintenance, so that it is possible to perform the operation in a state in which the plunger 32 is located in the vicinity of the ejecting port 16, i.e., the urging force of the plunger urging member 33 is small (or there is no urging force). Therefore, it is possible to prevent the driver 31 from vigorously operating during the maintenance operation, so that it is possible to safely replace the driver 31.

Furthermore, in the standby position for maintenance, the plunger 32 is located in the vicinity of the ejecting port 16, so that it is possible to replace the driver 31 simply by opening the vicinity of the nose part 15, without largely opening the front surface of a body. Therefore, the complicated structure such as the three-split housing 40 is not required, and the problems of the enlarged tool and the poor operability can be avoided.

The housing 40 of the striking tool 10 is configured by combining the left and right split pieces 40*b*. Moreover, the front surface of the housing 40 is formed with the notched shape 40*a* in the position facing the driver 31, the cover 41 to cover the notched shape 40*a* is detachably mounted, and when the cover 41 is detached in the state in which the plunger 32 is located in the standby position for maintenance, the notched shape 40*a* exposes the coupling place (driver fixing screw 32*d*) of the driver 31 and the plunger 32. According to this configuration, the standby position is switched to the standby position for maintenance, so that the plunger 32 is made to stand by in the vicinity of the ejecting port 16. In this state, the driver 31 can be replaced simply by detaching the cover 41 covering a part of the vicinity of the nose part 15. Therefore, it is not necessary to largely change a configuration of the existing housing 40, so that it is possible to prevent the increase in cost due to the complication of the mold structure and the increase in the number of components.

Also, the cover 41 has the driver guide function of guiding the sliding of the driver 31. According to this configuration, it is possible to simplify the structure because it is not necessary to separately provide parts configuring the ejecting path 49. Also, since it is possible to open the ejecting path 49 simply by detaching the cover 41, even when a staple jamming occurs in the ejecting path 49, for example, it is possible to easily solve the problem.

Also, a notification unit configured to notify that the plunger 32 is located in the standby position for maintenance may be provided. According to this configuration, since it is notified whether the plunger is located in the standby position for maintenance so as for the user to easily recognize, it is possible to prevent a situation in which the replacement operation of the driver 31 is erroneously performed in the usual standby position.

Also, a maintenance operation part for switching the standby position of the plunger 32 from the usual standby position to the standby position for maintenance may be provided. According to this configuration, when the maintenance operation part is operated, it is possible to switch the standby position.

Although not specifically described in the exemplary embodiment, the driver 31 may be configured to be splittable in a longitudinal direction, and only a part on a tip end side of the driver 31 may be replaced. That is, the driver 31 may be configured by a part on a base end side to be coupled to the plunger 32 and a part on a tip end side to be coupled to the part on the base end side, and only the part on the tip end side susceptible to damage may be replaced. According to this configuration, even for a machine in which it is difficult to expose the coupling place of the driver 31 and the plunger 32 in the state in which the cover 41 is detached, it is possible to perform the replacement operation of the driver 31. Even with the configuration, since it is possible to perform the operation after switching the plunger 32 to the standby position for maintenance, it is possible to safely replace the driver 31 in the state in which the urging force of the plunger urging member 33 is small (or there is no urging force). Also, since the plunger 32 is located in the vicinity of the ejecting port 16 in the standby position for maintenance, it is possible to replace the part on the tip end side of the driver 31 without largely opening the front surface of the body.

What is claimed is:

1. A striking tool comprising:

a driver which is provided to be slidable toward an ejecting port at a nose part of the striking tool so as to strike out a fastener from the ejecting port;

a plunger to which the driver is coupled;

a plunger urging member which urges the plunger toward the ejecting port;

a drive mechanism which moves the plunger to accumulate an urging force in the plunger urging member;

a housing which includes a notch at a position facing the driver; and a cover which is detachably mounted on the housing, and which covers the notch of the housing in a state in which the cover is attached to the housing, wherein a standby position of the plunger before striking out the fastener can be switched between a usual standby position and a standby position for maintenance closer to the ejecting port than the usual standby position, and wherein a coupling place of the driver and the plunger is exposed within the notch in a state in which: (i) the cover is detached from the housing, and (ii) the plunger is located in the standby position for maintenance.

2. The striking tool according to claim 1, wherein the housing of the striking tool is configured by combining left and right split pieces.

3. The striking tool according to claim 1, wherein the cover has a driver guide function of guiding sliding of the driver.

4. The striking tool according to claim 1, further comprising a notification unit which provides a notification that the plunger is located in the standby position for maintenance.

5. The striking tool according to claim 1, further comprising a maintenance operation part which switches is configured to switch the standby position of the plunger from the usual standby position to the standby position for maintenance.

6. The striking tool according to claim 1, wherein the coupling place of the driver and the plunger is covered by the housing in a state in which the plunger is located in the usual standby position, and wherein the coupling place of the driver and the plunger is covered by the cover in a state in which:

(i) the plunger is located in the standby position for maintenance, and (ii) the cover is attached to the housing.

7. The striking tool according to claim 1, wherein the usual standby position is a position between a top dead center position of the plunger and a bottom dead center position of the plunger, wherein the plunger moves from the top dead center position to the bottom dead center position such that the driver strikes the fastener from the ejecting port.

8. The striking tool according to claim 7, wherein the standby position for maintenance is the bottom dead center position.

9. The striking tool according to claim 1, further comprising an operation part which executes operation of striking out the fastener from the ejecting port, wherein the plunger is switched from the standby position for maintenance to the usual standby position upon actuation of the operation part to execute the operation of striking out the fastener from the ejecting port.

10. A striking tool comprising:

a driver which is provided to be slidable toward an ejecting port at a nose part of the striking tool so as to strike out a fastener from the ejecting port;

a plunger to which the driver is coupled;

a plunger urging member which urges the plunger toward the ejecting port;

a drive mechanism which moves the plunger to accumulate an urging force in the plunger urging member;

a housing which includes a notch at a position facing the driver; and a cover which is detachably mounted on the housing, and which covers the notch of the housing in a state in which the cover is attached to the housing, wherein a standby position of the plunger before striking out the fastener can be switched between a usual standby position and a standby position for maintenance closer to the ejecting port than the usual standby position, wherein the driver includes a first part on a base end side coupled to the plunger and a second part on a tip end side coupled to the first part, and the second part of the driver is replaceable, and wherein a coupling place of the first part and the second part is exposed within the notch in a state in which: (i) the cover is detached from the housing, and (ii) the plunger is located in the standby position for maintenance.

11. The striking tool according to claim 10, wherein the coupling place of the driver and the plunger is covered by the housing in a state in which the plunger is located in the usual standby position, and wherein the coupling place of the driver and the plunger is covered by the cover in a state in which: (i) the plunger is located in the standby position for maintenance, and (ii) the cover is attached to the housing.

12. The striking tool according to claim 10, wherein the usual standby position is a position between a top dead center position of the plunger and a bottom dead center position of the plunger, wherein the plunger moves from the top dead center position to the bottom dead center position such that the driver strikes the fastener from the ejecting port.

13. The striking tool according to claim 12, wherein the standby position for maintenance is the bottom dead center position.

14. The striking tool according to claim 10, further comprising an operation part which executes operation of striking out the fastener from the ejecting port, wherein the plunger is switched from the standby position for maintenance to the usual standby position upon actuation of the operation part to execute the operation of striking out the fastener from the ejecting port.

* * * * *